US006634492B1

(12) United States Patent
Cox

(10) Patent No.: US 6,634,492 B1
(45) **Date of Patent: *Oct. 21, 2003**

(54) STORAGE DEVICE FOR A SHAVING RAZOR

(76) Inventor: Jerry Cox, 310 E. 74th St., New York, NY (US) 10021

( * ) Notice: Subject to any disclaimer, the term of this patent is extended or adjusted under 35 U.S.C. 154(b) by 6 days.

This patent is subject to a terminal disclaimer.

(21) Appl. No.: 09/709,941

(22) Filed: Nov. 10, 2000

Related U.S. Application Data

(63) Continuation-in-part of application No. 09/439,405, filed on Nov. 11, 1999, now Pat. No. 6,145,657.

(51) Int. Cl.[7] ..... A45D 27/22
(52) U.S. Cl. ..... 206/208; 206/228
(58) Field of Search ..... 206/15.3, 208, 206/222, 228, 349, 351, 362.3; 30/34.05

(56) References Cited

U.S. PATENT DOCUMENTS

| | | | | |
|---|---|---|---|---|
| 1,189,118 A | | 6/1916 | Jonas | |
| 1,912,627 A | | 6/1933 | Dyer | |
| 2,027,899 A | | 1/1936 | Bruce | |
| 2,443,495 A | | 6/1948 | De Tuesta | |
| 2,792,108 A | * | 5/1957 | Keller | |
| 3,759,594 A | | 9/1973 | Cobb | |
| 4,198,745 A | | 4/1980 | Moehlenpah | |
| D258,270 S | | 2/1981 | Gray | |
| 5,007,533 A | | 4/1991 | Purohit | |
| 5,251,752 A | | 10/1993 | Purohit | |
| 5,615,858 A | * | 4/1997 | Sferruzza, Jr. | 248/682 |
| 6,009,622 A | | 1/2000 | Liedblad | |
| 6,145,657 A | * | 11/2000 | Cox | 206/208 |

* cited by examiner

*Primary Examiner*—David T. Fidei
(74) *Attorney, Agent, or Firm*—Stroock & Stroock & Lavan LLP

(57) ABSTRACT

A housing for a shaving razor with razor blade(s) immersed in oil or another liquid. The primary structure permits a minimal quantity of oil or other liquid to submerge the razor blade with the razor handle upright. It also may feature a catch extension on the back wall to aid oil drainage from the submersed end. The second structure is a frontally mounted lid with razor handle positioned for easy access. To secure the housing in the desired position, a "hook and loop" type attachment device can be provided to allow removal for cleaning. In another embodiment, an insert may be disposed within the housing, next to the back wall. The insert has a razor handle receiving portion and a razor blade catch extension. In another embodiment, the housing may be formed in a free-standing configuration so that it may be rested upon a countertop or table. This embodiment may be formed with a container holding portion having an oil container recess. An oil container may be placed and stored in the oil container recess. In another embodiment, a handle support groove is defined by the housing.

7 Claims, 9 Drawing Sheets

STORAGE DEVICE FOR A SHAVING RAZOR

CROSS-REFERENCE TO RELATED APPLICATION

This is a continuation-in-part of application Ser. No. 09/439,405, filed Nov. 11, 1999 now U.S. Pat. No. 6,145,657.

BACKGROUND OF THE INVENTION

This invention is directed to a housing for storing a razor, and in particular, to a shaving razor storage device which reduces corrosion of a razor blade housed therein. Since the bronze age, men of many societies have sought to improve their method of removing facial hair with a metal blade. Through that long history of shaving instruments, improvements have focused on blade quality. Better alloys, better handling and control methods and now, multiple blades with separation for better bristle clearance have been introduced.

As the art graduated to the expediency of the safety razor, the double-edged blade was dominant and gadgetry evolved to produce other symbiotic instruments with balance, weight and esthetic appeal in mind. The single-edge injector razor was the next leap forward as the "disposable" society sought to avoid accidental lacerations. These devices included a handle which included an attaching structure for receiving a disposable blade. The handle may have been made of plastic or metal. The blade was made of metal, but may have been housed in a plastic cartridge. This led to a whole progression of plastic/metal combinations connected to a primary handle to effect utility for travel, variable blade angle, durability and simplicity of use. Most recently, the double-edged razor has evolved into the triple-edged razor.

Alloys of various composition have been created to provide razors with sharper edges to retain that sharpness through their innate hardness and resistance to oxidation. Even space-age materials have been adapted which perform better than those previous compositions of high carbon content. However, it is well-known that metal blades rust and/or corrode as a result of use and exposure to oxygen. It is also known that metal immersed in oil or other such liquids is not subject to corrosive effects of oxygen and though some attempts have been made to apply this fact to shaving implements, such attempts have been impractical or not worth the trouble.

SUMMARY OF THE INVENTION

The present invention consists of a housing to house a razor blade and handle unit which is positioned so that the razor blade may be immersed in oil or a like liquid when not in use. More specifically, the invention is directed to a structure capable of housing a shaving razor such that the razor blade is immersed in oil or a like liquid for the purpose of extending the razor blade serviceability well beyond previous expectations and with convenience and utility that improves on previous art.

The storage device for storing a shaving razor handle and razor blade has a housing having a front wall. The front wall defines in part a housing opening for receiving said shaving razor handle and razor blade. A liquid storage well formed within the housing is capable of storing liquid and receiving said razor blade therein. A front lip is formed on the front wall for supporting the razor handle. A handle slot is disposed in the housing for receiving the shaving razor handle and for allowing the razor blade to be positioned in the liquid storage well. The housing opening allows the handle to pivot between a first position in the slot to a second position in the housing opening. A razor blade catch member disposed internally of the housing between the handle slot and liquid storage well engages the razor blade and positions the razor blade above the liquid storage well when the handle is in the second position.

In an exemplary embodiment, the housing may be fabricated of an oil compatible material such as high-impact molded plastic, for lighter weight. The liquid disposed in the housing may contain an oil or such liquid which will preferably not degrade the housing. It is preferred that the oil or such liquid will be as tasteless, odorless and colorless as possible and not adversely affect the razor support material or the housing.

In an exemplary embodiment the housing may be easily mounted in a medicine cabinet or on the wall and will have a pivotally attached lid. A hinged lid may be provided in the case of outside-cabinet location.

In another exemplary embodiment, the lid may have one or more protrusions, while the housing has one or more corresponding recesses. The protrusion or protrusions on the lid are dimensioned to matingly engage with the recess or recesses in the housing to facilitate and enhance removable attachment of the lid to the housing. The lid may have tabs, with the protrusions being disposed on the tabs.

The storage device may have an insert disposed within the housing. The insert may be formed of the same material as the housing, or in the alternative, may be formed of a different material, such as an opaque plastic when the housing is formed of a translucent plastic. Features, such as the razor blade catch member discussed above, or a razor blade handle receiving portion, may be formed in the insert. The insert may be manufactured separately from the housing, and then subsequently disposed within the housing, adjacent to the back wall. The insert may be attached to the back wall by a press fit, adhesives, or other methods known in the art. The razor blade handle receiving portion helps to align and position the razor handle when the razor is in the upright, first position, so that the razor blade is within the well and the oil. A benefit of the use of the insert is that the features mentioned above may be more easily formed on the separate insert than directly on the back wall of the housing. Thus, the use of the insert may, under certain circumstances, reduce manufacturing complexity and its associated costs.

In another exemplary embodiment, the storage device may be designed as a freestanding unit. As a free-standing unit, the housing rests upon a counter top, table, or other flat surface. As part of the free-standing design, a handle holder, partially defining a handle holding aperture, extends outwardly from the housing. The handle holder and handle holding aperture receive the shaving razor handle and help to position the razor blade in the well.

In a free-standing embodiment, the housing has a base at the bottom, which may have a pad disposed on a base bottom. The pad helps to prevent a counter top or other flat surface from being scratched or otherwise damaged when the free-standing storage device is set down on, or moved across a flat surface. Further, the base may be weighted so that the storage device is resistant to tipping. Also, a gripping handle may be disposed on the housing to aid in repositioning or moving the storage device.

In another embodiment, the base may have a container holding portion. The container holding portion defines a container recess for receiving a container. An oil container holding a reserve of replacement oil, or any other suitable material such as cologne or antiseptic, may be placed in the container recess of the container holding portion. The container holding portion may be formed with other features such a drainage port, which facilitates drainage of oil or other liquids that may have accumulated in the container recess.

In another exemplary embodiment, the storage device may be formed with a housing having a liquid storage well formed therein for storing the liquid and receiving the razor blade therein, with a well opening defined, in part, by the liquid storage well. In this embodiment, a handle support groove is defined in the housing for receiving the shaving razor handle and for allowing the razor blade to be positioned in the liquid storage well. The handle support groove supports the razor handle. Also, a well cover is removably positioned over the well opening. A handle for receiving the razor handle is defined by the well cover.

It is an object of this invention to create an environment for a razor blade which will extend the blade's period of its effective use.

It is another object to provide a neat and sanitary environment for storing a razor between uses.

It is also an object of the present invention to effectively reduce the number of razors thrown-away in a given period of time.

Still other objects and advantages of the invention will be apparent from the specifications.

It will thus be seen that the objects set forth above, and those made apparent from the preceding description, are efficiently attained and, because certain charges may be made in the disclosed constructions without departing from the spirit and scope of the invention, it is intended that all matter contained in this description, and as shown in the accompanying drawings, shall be interpreted as illustrative and not limiting.

The invention accordingly comprises the features of construction, combination of elements, and arrangement of parts which will be exemplified in the constructions hereinafter set forth and the scope of the invention will be indicated in the claims.

BRIEF DESCRIPTION OF DRAWINGS

For a fuller understanding of the invention, reference is now made to the following descriptions and the accompanying drawings.

DETAILED DESCRIPTION OF THE PREFERRED EMBODIMENTS

Figure 1:
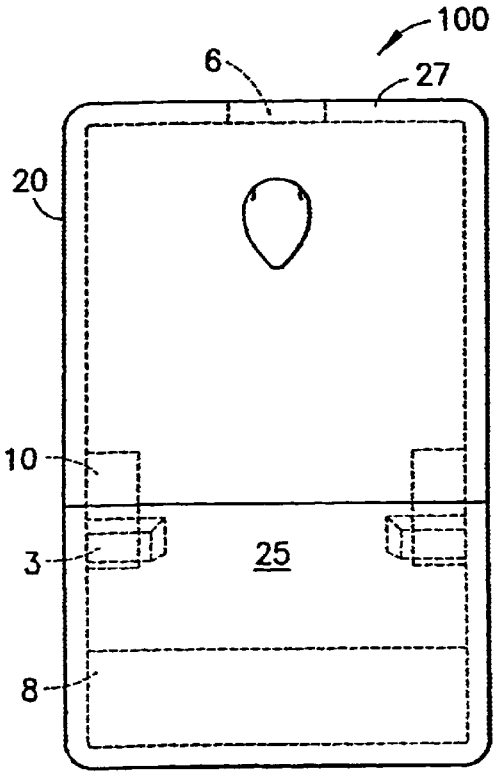
FIG. 1 is a front elevational view of the housing of the present invention showing internal structural features in phantom.
Figure 2:
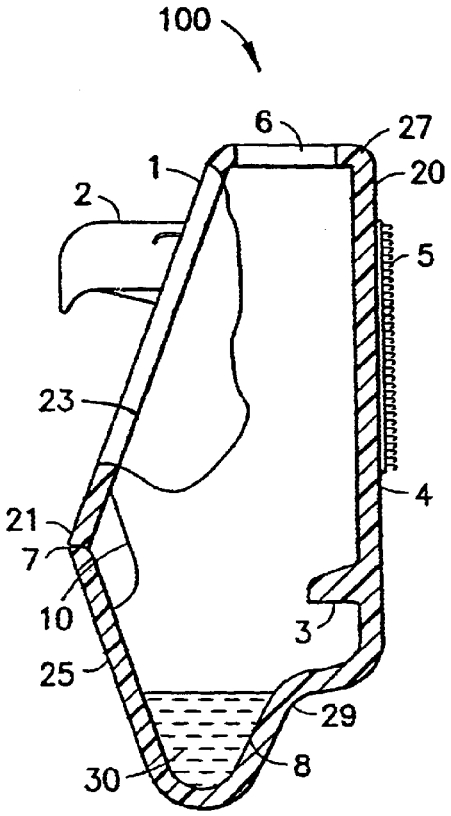
FIG. 2 is a side cross-sectional view of the housing.

Reference is made to FIGS. 1–6 in which a device for storing a razor having both a blade and a handle, generally indicated as 100, is provided. The storage device 100 includes a housing 20. Housing 20 includes a roof 27 and a front wall 25 having a lip 7. An opening is formed between front wall 25 and a roof 27. A back wall 4 and bottom 29 complete housing 20. Housing 20 also includes a liquid storage well 8 for storing liquids such as oil or other types of solutions. The liquid storage well 8, according to the preferred embodiment, has a shape and capacity which will allow a razor blade to be easily positioned within the liquid storage well 8. In addition, it is preferable to shape the liquid storage well 8 so that it may be easily cleaned.

As shown in FIG. 1, a detachable lid 1 is provided to allow easy access to the interior of housing 20 to insert and remove a razor 13 through an opening 23. In the preferred embodiment, lid 1 has a lift handle 2, or the like, to allow one to easily and quickly open and close lid 1. Also, lid 1 may have legs 10 disposed at either side thereof. These legs 10 are attached to the housing 20 at the interior of front wall 25 in such a manner as to permit firm seating of lid 1 while allowing easy removal of the same. In addition, the lower edge 21 of lid 1 may be shaped to match that of the front lip 7 of front wall 25.

In a preferred embodiment, housing 20 may be made of a durable material or a high-impact plastic to accommodate repeated usage. It is preferred that housing 20 be made of a lightweight material. Additionally, it is desirable to form housing 20 from a smoky gray material that is about 30% in value gradient, for example, since this would allow inspection of the oil/solution level, the presence of hair residue, and the like.

A handle slot 6 capable of receiving a razor handle is formed in roof 27. In the preferred embodiment, the handle slot 6 is a centered slot as shown in FIG. 1.

Lastly, a razor blade catch member 3 extends from back wall 4 into the interior of housing 20 and, in an exemplary embodiment, in the general direction of wall 25. The razor blade catch member 3 has an underside extending outward from back wall 4 and, by way of example, beveled downward at a 15 degree angle. The razor blade catch member 3 is outwardly extended sufficiently to support a blade 11 and handle 12 of razor 13 without damage at entry or extraction.

The housing 20 of the preferred embodiment need not be airtight, but should be atmospherically discreet. This would thus allow for simple access to the blade 11 and handle 12 of a razor 13 with minimal air exchange. It should be noted that this invention may evolve into gift versions of a more elaborate nature, i.e. the old fashioned shaving cups of yore and present shaving kits.

Figure 3:
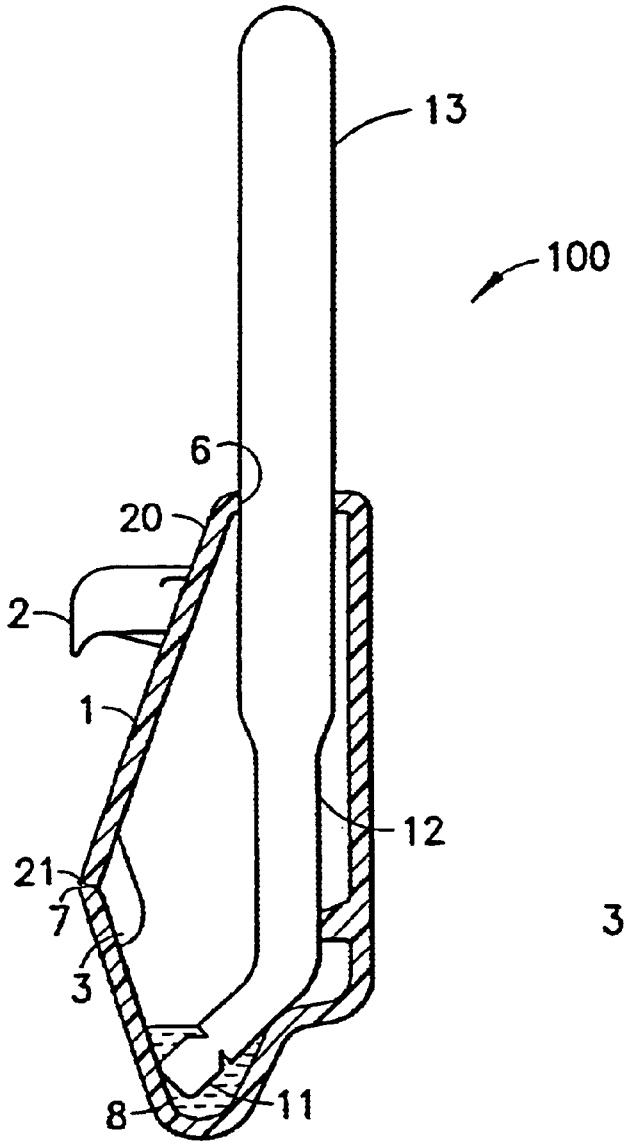
FIG. 3 is a side sectional view of the housing showing a razor housed therein.

During use razor 13 is placed in housing 20 so that razor blade 11 is disposed in well 8 and oriented so that handle 12 is received in slot 6 of roof 27. An oil 30, or some other liquid having a property which preserves blade 11, is disposed in well 8 at least at a level such that blade 11 displaces a sufficient volume of oil 30 to envelop blade 11 (FIG. 3). By way of non-limiting example, the oil 30 is preferably mineral oil, or could be a plant derivative with tocopherol vitamin E as an anti-oxidant stabilizer. It may also contain an effective amount of a biocide. Lid 1 is placed over opening 23, sealing razor 13 therein and further protecting it from dirt and oxidation. When a user is ready to use the razor 13, the user may grasp the lift handle 2 to open the lid 1 in order to access the handle 12.

Figure 5:
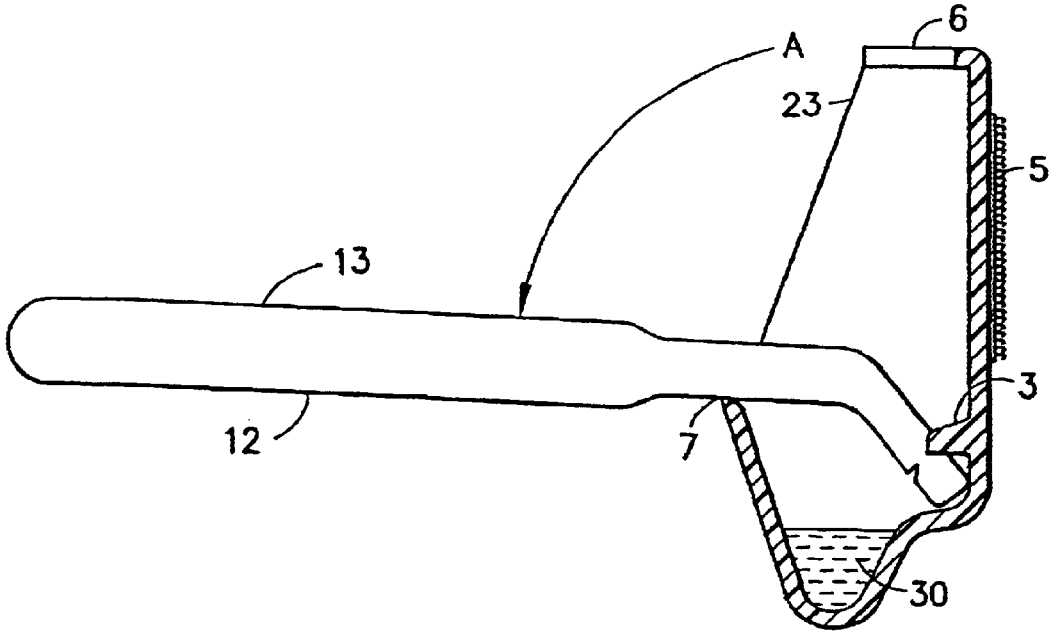
FIG. 5 is a side cross-sectional view of the housing shown in FIG. 3 with the razor shown in drain position.

Referring now to FIG. 5, the handle 12 can be removed from slot 6 and rotated in the direction of an arrow A, as shown, into position on a front lip 7. In this position, the blade 11 engages razor blade catch member 3. Because the center of gravity of razor 13 is outside of housing 20, gravity causes blade 11 to be held against razor blade catch member 3. This position, hereinafter known as the drain position, allows any oil or solution contained on the blade 11 to be drained so that the oil 30 or other such solution collects in the liquid storage well 8. The front lip 7 of the preferred embodiment may be beveled to minimize wear to the razor in the drain position as well as accommodate razors of different drain angles. Once sufficiently drained, the razor 13 is ready to be used for shaving. Of course, one may shave prior to having the blade 11 drained, but such draining is preferred. If, for example, sunflower oil is the oil 30 in which blade 11 is stored, it has been determined by testing that no more than 5 seconds is required for the oil to be drained from blade 11. Of course, different types of liquids will have different drainage rates.

The storage device 100 not only provides for convenient storage and access to razor 13 while extending blade serviceability, but also provides a better cost amortization. The cost may be as little as 1.5 cents per shave or approximately one-fifth of present usage.

This invention is not intended to be limited to any particular type of razor 13. By way of example, blade 11 can be a single blade razor, a double blade razor or a triple blade razor as well as any other razor blade that is or may become commercially available.

An attachment member 5 may be used to attach the housing 20 to a medicine cabinet or on a wall. Attachment member 5 may be user applied and can have any dimensions and configuration sufficient to support housing 20. In the preferred embodiment, the attachment member 5 is marine quality "hook and loop" type attachment device, such as VELCRO brand fasteners. This will allow for the housing 20 to resist lateral and vertical stress while permitting removal for occasional cleaning. Additionally, the housing 20 can be easily mounted and remounted.

Figure 4:
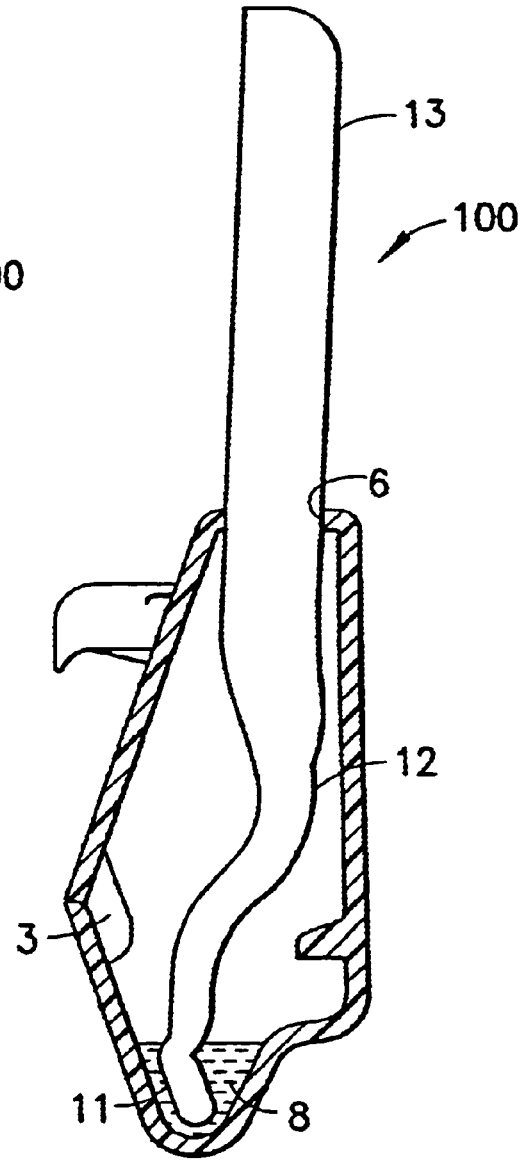
FIG. 4 is a side cross-sectional view of the housing showing an alternate razor housed therein.
Figure 6:
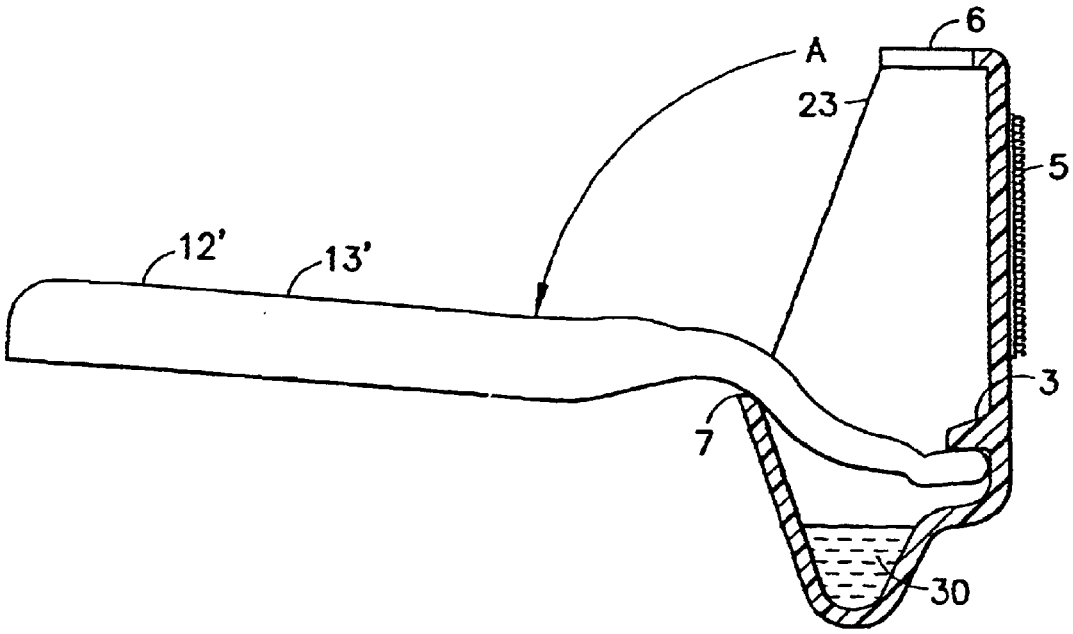
FIG. 6 is a side cross-sectional view of the housing shown in FIG. 4 with the alternate razor shown in drain position.

The present invention was described with specific reference to razor 13 in FIGS. 3 and 5. However, as shown in FIGS. 4 and 6, the invention can also accommodate different shaped razors such as razor 13'. Each razor 13' has its handle 12' with its blade 11' oriented so as to be immersed in an oil 30 or other like liquid. In the preferred embodiment, the housing 20 is adaptable to be easily mounted inside or outside bathroom cabinetry and to be durable, functional and esthetically agreeable.

Figure 7:
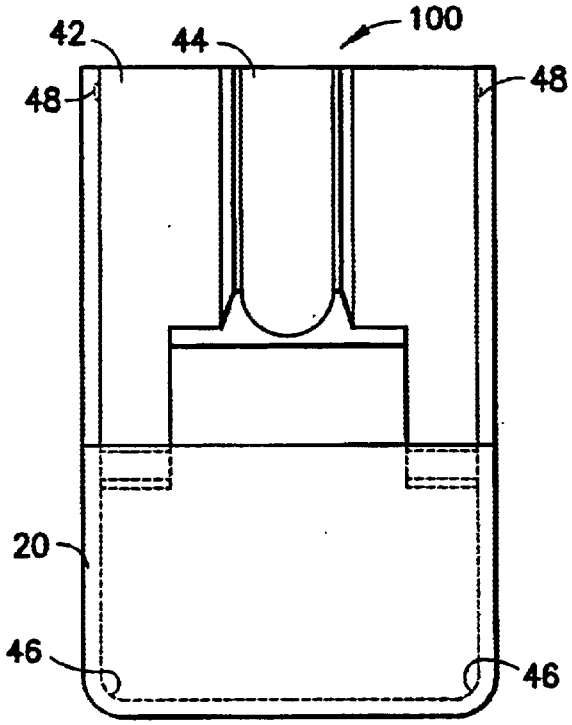
FIG. 7 is a front elevational view of another embodiment of the housing having an insert disposed therein.
Figure 8:
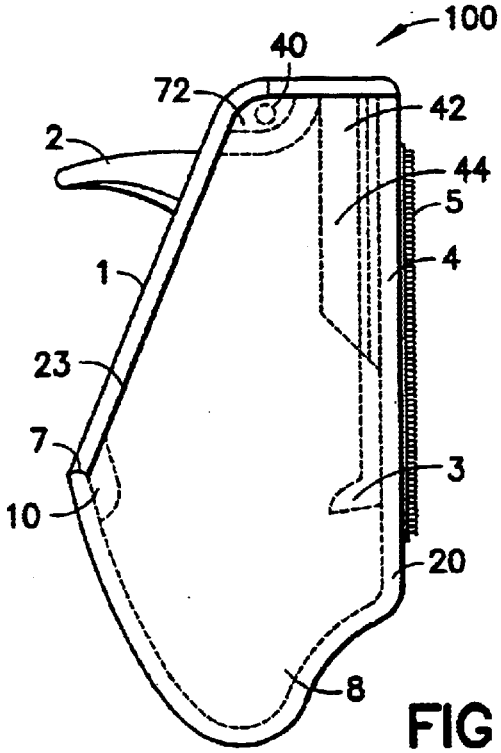
FIG. 8 is a side cross-sectional view of the housing of FIG. 7 with a lid disposed thereon.
Figure 9:
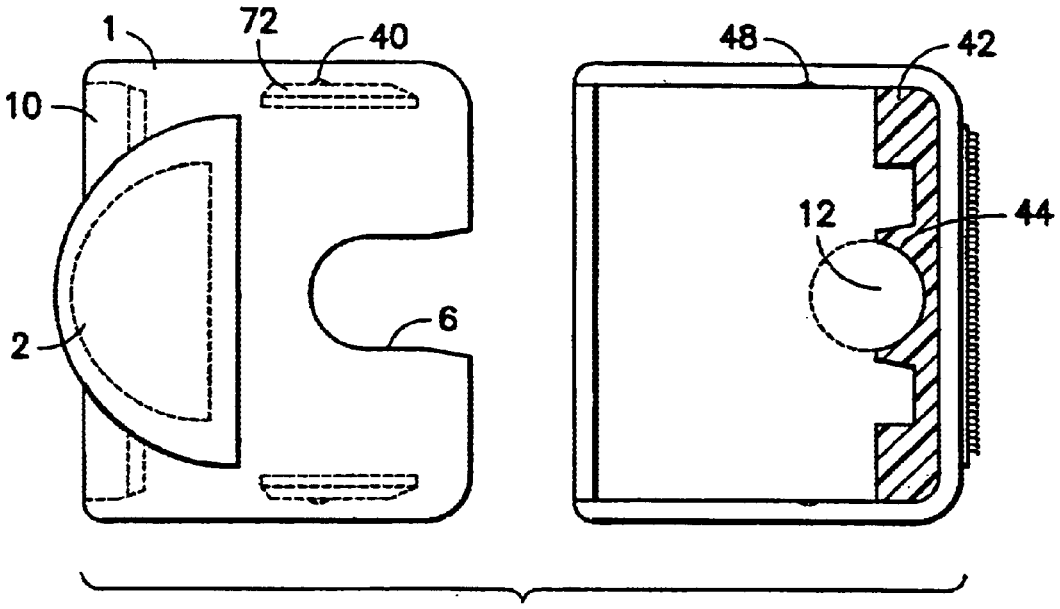
FIG. 9 is an exploded top plan view of the housing and lid of FIG. 8.

Another embodiment of the invention is shown in FIGS. 7–9. In this embodiment, storage device 100 further comprises an insert 42, disposed within the housing 20, adjacent back wall 4. In this embodiment, catch members 3 are disposed on insert 42, instead of on back wall 4, as in a previous embodiment. Also disposed on insert 42 is handle receiving portion 44, which facilitates alignment and positioning of and holds the handle 12 when the razor is in the storage position. Insert 42 may be secured to back wall 4 by a press fit design, a snap fit, or adhesive attachment. Alternatively, any other suitable mounting technique can be used to secure insert 42 within housing 20. In an exemplary embodiment, insert 42 may be formed of high-impact molded plastic, or other art recognized material.

A benefit to providing insert 42 is that the manufacturing process is simplified because features such as handle receiving portion 44 and catch member 3 may be more easily formed on a separate piece such as insert 42 than directly on back wall 4 of housing 20. Additionally, different inserts designed to accommodate different types of razors could be used. Accordingly, the use of an insert allows for the addition of and flexibility of changing features at a relatively low manufacturing cost.

As shown in FIGS. 7 and 9, lid 1 may be formed with tabs 72 having protrusions 40 and housing 20 may be formed with recesses 48, dimensioned to matingly engage protrusions 40, formed therein. In use, protrusions 40 temporarily deform and tabs 72 temporarily deflect inwardly as lid 1 is placed onto housing 20. Since protrusions 40 and tabs 72 are formed of a resilient material, their deformation will only be temporary, and after lid 1 is put in place on housing 20, the protrusions 40 and tabs 72 will return to their original, or substantially their original, shape, and thereby hold the lid securely in place.

Housing 20 may also be formed with rounded bottom corners 46. Rounded bottom corners 46 facilitate easy cleaning of housing 20 as small particles of hair and debris may be more easily removed than if the bottom comers of the housing are sharp. Also, well 8 formed in housing 20 may be dimensioned to accommodate razors of various sizes and shapes, as are commonly found in commerce.

Figure 10:
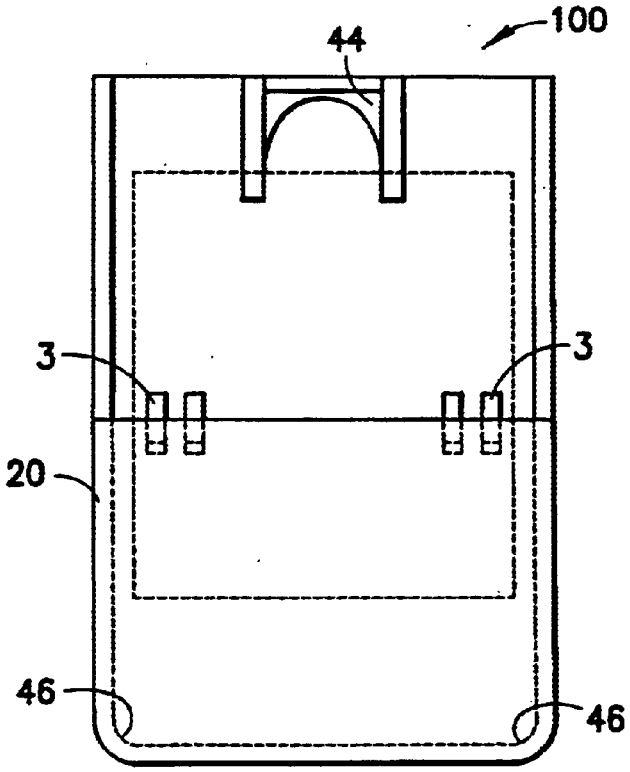
FIG. 10 is a front elevational view of another embodiment of the housing.
Figure 11:
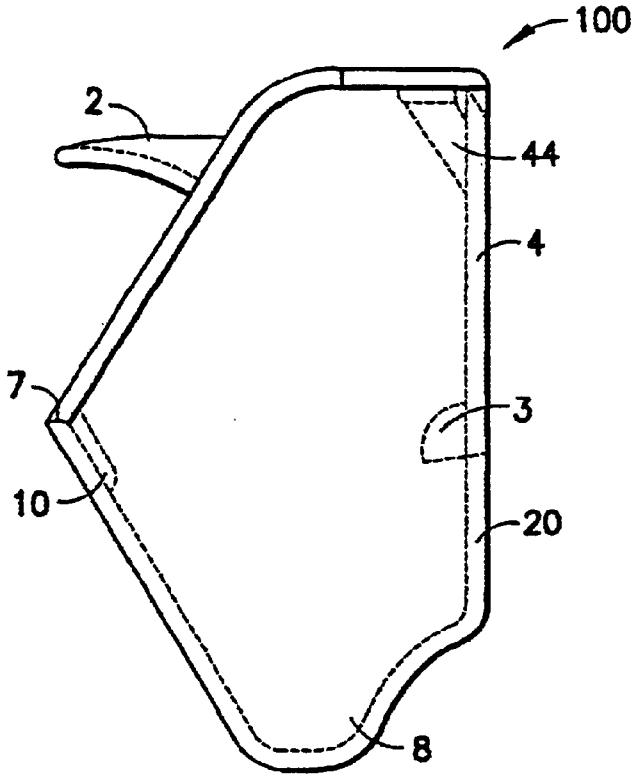
FIG. 11 is a side cross-sectional view of the housing of FIG. 10 with a lid disposed thereon.
Figure 12:
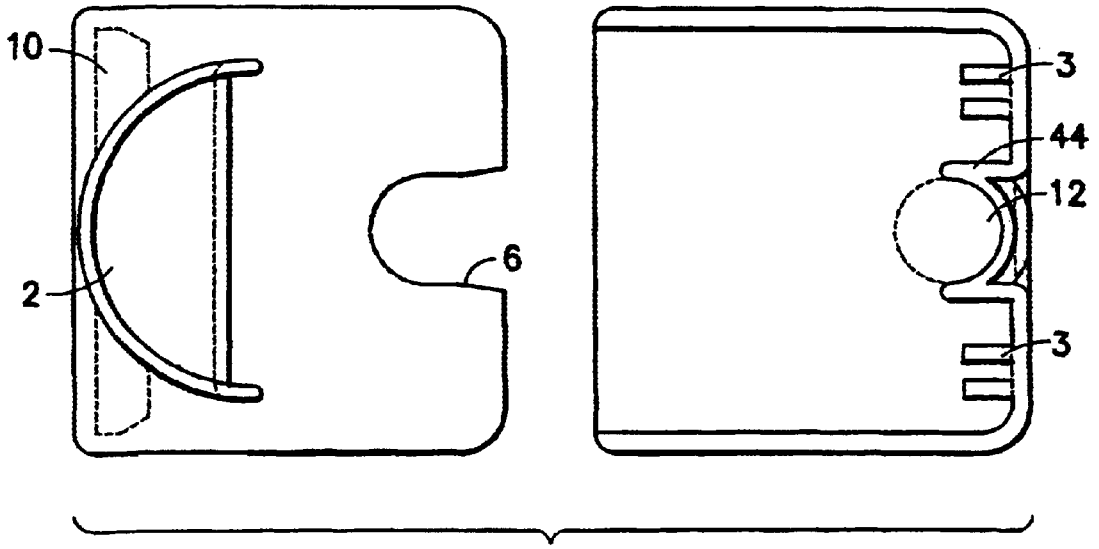
FIG. 12 is an exploded top plan view of the housing and lid of FIG. 11.

Another embodiment of the invention is shown in FIGS. 10–12. In this embodiment, catch members 3 are disposed directly on back wall 4, as is handle receiving portion 44. As in a previously discussed embodiment, handle receiving portion 44 facilitates alignment and positioning of and holds the handle 12 when the razor is in the storage position.

As in the previously disclosed embodiments, housing 20 may be made of a durable material or a high-impact plastic to accommodate repeated usage. It is preferred that housing 20 be made of a lightweight material. Additionally, housing 20 may be formed to have a uniform thickness, thus providing for uniform cooling during the manufacturing process, as is known in the art.

Figure 13:
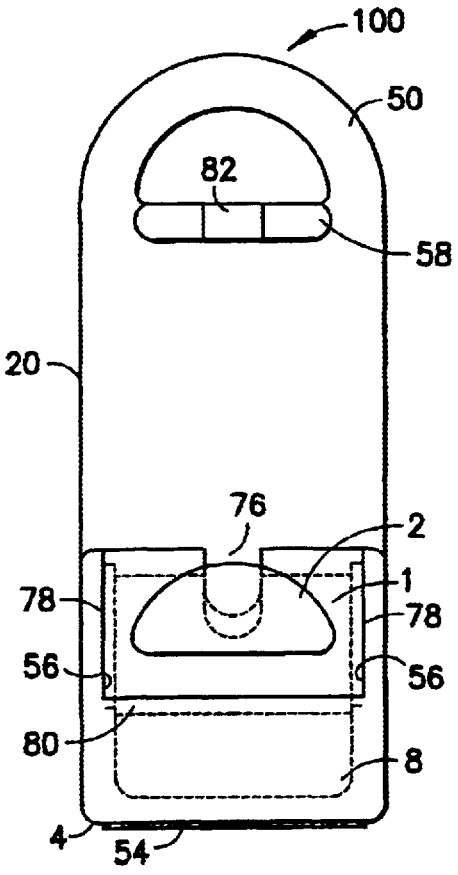
FIG. 13 is a front elevational view of another embodiment of the invention.
Figure 14:
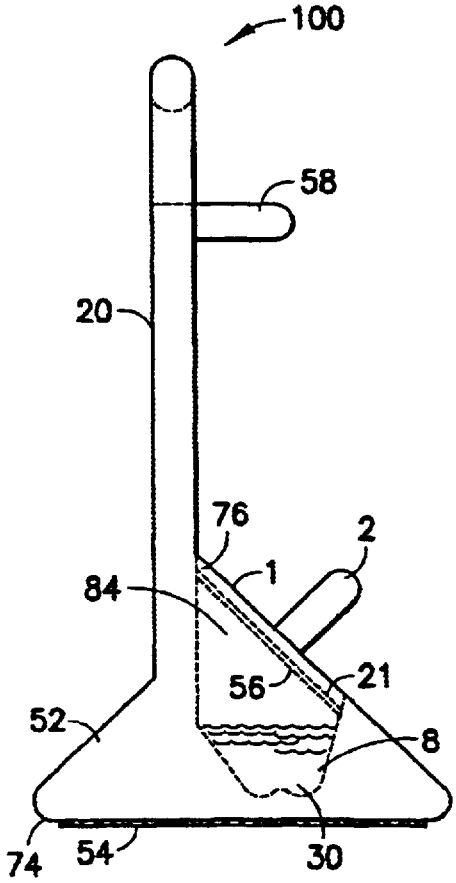
FIG. 14 is a side cross-sectional view of the invention of FIG. 10, with a portion of the depicted device broken away.

Referring now to FIGS. 13 and 14, another embodiment of the storage device of the present invention is shown. Storage device 100 may be formed in a free-standing configuration that can be rested upon a counter top or table, instead of being mounted on a wall or to the wall of a medicine cabinet. In this embodiment, storage device 100 is formed with base 52, in order to facilitate stable placement of storage device 100 on a counter op, table, or other substantially horizontal surface. In an exemplary embodiment, base 52 may be weighted such that the center of gravity of the storage device 100 is lowered and the storage device is stabilized and is resistant to tipping. Base 52 may be weighted by forming base 52 of a solid piece of material, while the remainder of housing 20 is formed of hollow material. In the alternative, base 52 could be formed to be hollow, with ballast material (not shown) disposed within base 52. The ballast material could be a relatively heavier plastic than that used to form the housing, as well as sand, other granular substances, or a liquid, such as water. A pad 54, formed of cork, rubber, or any other similar art-recognized material, may be disposed on a base bottom 74. Pad 54 prevents storage device 100 from scoring or scratching the surface that it is placed upon. Pad 54, if it possesses a relatively high coefficient of friction, as compared to housing 20 and the surface that the storage device 100 is resting upon, may help to prevent slippage and aid the user in placing a razor into and removing a razor from storage device 100.

In this embodiment, a gripping handle 50 is disposed at the top of housing 20. In a preferred embodiment, gripping handle 50 is formed integrally with housing 20 and allows the user to easily pick up and reposition the storage device 100.

Also, in this embodiment, handle holder 58 is disposed on, and extends outwardly from housing 20, and is formed with handle holding aperture 82. Handle holding aperture 82 is dimensioned to receive the handle 13 of a razor 12 when the razor is placed in a storage position. A lid 1, is formed with handle 2, which facilitates the removal and replacement of the lid 1 to cover well opening 84 and the well 8. Well 8 is formed with step portions 56 which extend from the inner sides 78 of well 8. When lid 1 is positioned to cover well 8, lid 1 rests upon step portions 56 and bottom edge 80, and is held in place by its own weight.

During use razor 13 is placed in housing 20 so that blade 11 is disposed in well 8 and oriented so that handle 12 is received in handle holding aperture 82 defined by handle holder 58. An oil 30, or some other blade preserving liquid is disposed in well 8 as discussed with regard to the aforementioned embodiments. Lid 1 is placed over opening 23 sealing razor 13 therein, further protecting it from dirt and oxidation. Lid 1 defines handle receiving slot 76, which permits lid 1 to cover well 8 when razor 13 is in the storage position. When a user is ready to use the razor 13, the user may grasp the lift handle 2 to open the lid 1 in order to access the handle 12.

Figure 15:
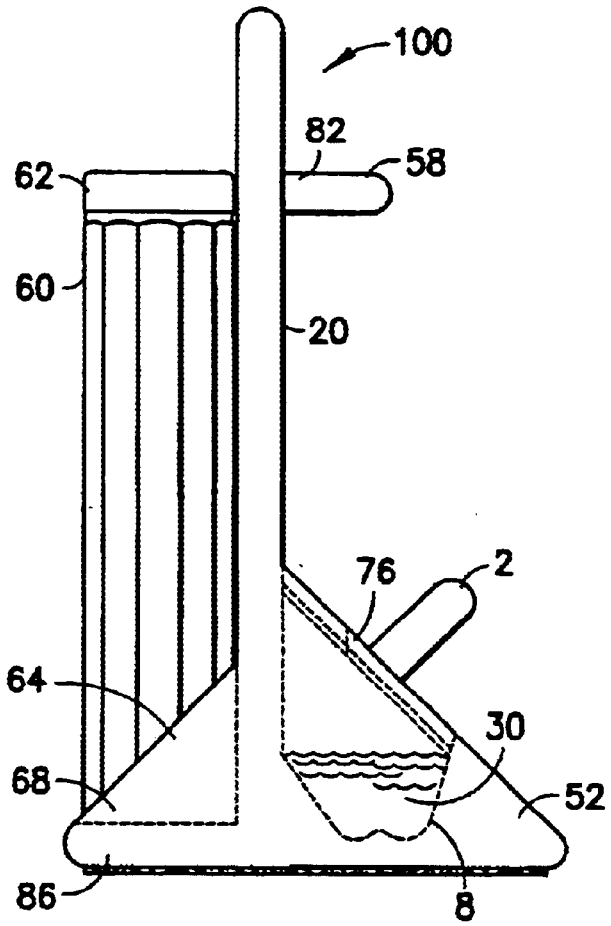
FIG. 15 is a side cross-sectional view of another embodiment of the invention, also with a portion of the device broken away.
Figure 16:
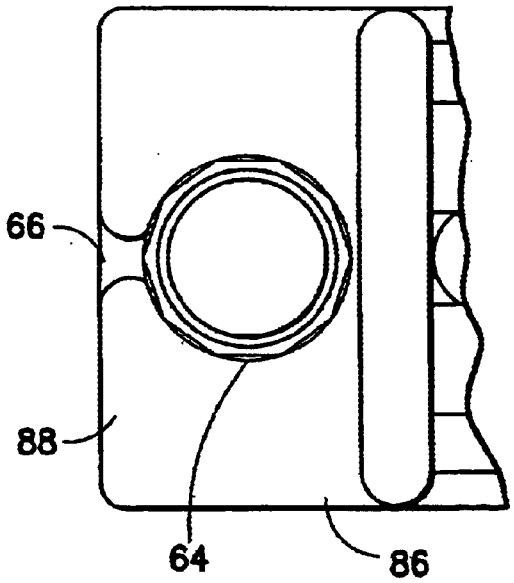
FIG. 16 is a top plan view of a portion of the embodiment shown in FIG. 12.

Turning now to FIGS. 15 and 16, another embodiment of the invention is shown. This embodiment includes features found in the previously discussed embodiment, and in addition, weighted base 52 also includes a container holding portion 86 located apart from the well 8. Top surface 88 of container holding portion 86 defines oil container recess 64. Oil container side portions 68 extend upward along the perimeter of oil container recess 64, forming a frustrocylindrically shaped structure. Alternatively, other shapes could be also be used. An oil container 60 may be removably disposed in oil container recess 64 on container holding portion 86. Drainage port 66 is defined in one side of oil container recess 64 and allows liquid such as oil or water that would otherwise tend to accumulate in oil container recess 64 to drain out.

Oil container 60 is used to hold a reserve of oil (or other liquid) so that, when the oil 30, within well 8 becomes excessively filled with contaminants, the oil 30 from well 8 may be discarded and well 8 may be refilled from oil container 60. Oil container 60 may be formed from glass, metal, plastic, or other art recognized material. Alternatively, oil container 60 could hold an antiseptic, cologne or even a beverage.

In an exemplary embodiment, a cap 62 is detachably disposed on oil container 60, and isolates the oil within the container 60 from outside contaminants. Cap 62 may be secured to oil container 60 either by press fit engagement, a threaded connection, or any other art-recognized manner.

Figure 17:
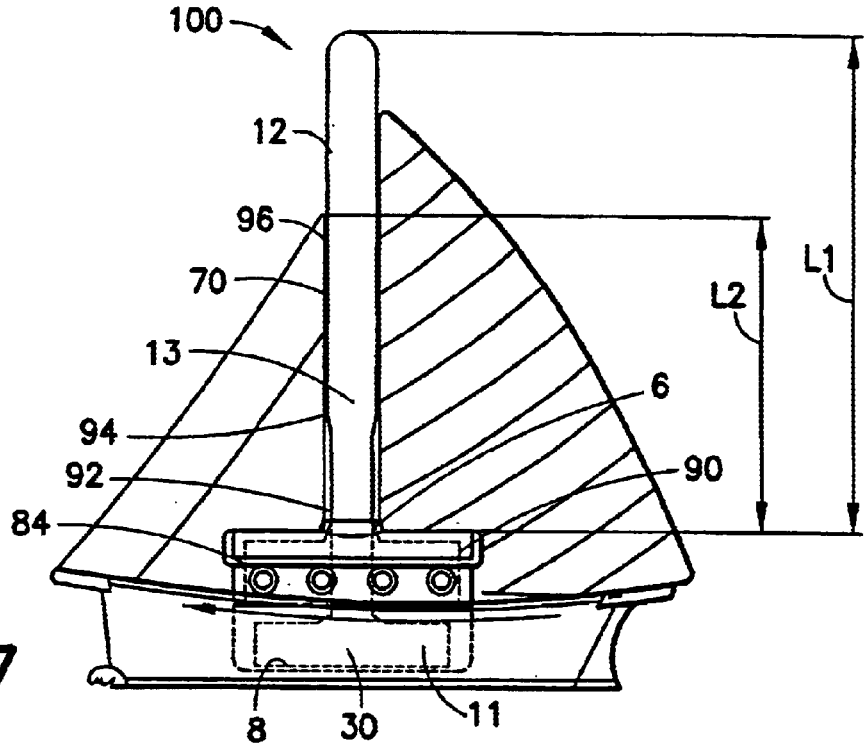
FIG. 17 is an elevational view of another embodiment of the invention.
Figure 18:
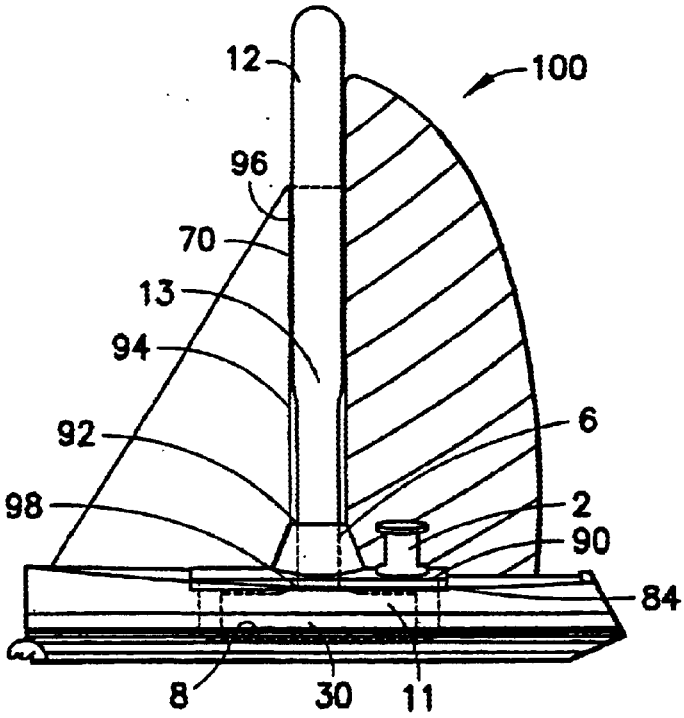
FIG. 18 is an elevational view of another embodiment of the invention.

Another embodiment of the invention is shown in FIGS. 17 and 18. In this embodiment, storage device 100 comprises a housing 94, a handle support 96 having handle support groove 70 defined therein, a well 8, and a well cover 90. Well cover 90 defines handle slot 92. During use razor 13 is placed such that handle 12 is partially disposed within handle support groove 70 so that blade 11 is disposed in well 8. Handle support groove 70 is dimensioned to receive and support handle 12 of razor 13. In an exemplary embodiment, the length L2 of handle support groove 70 is dimensioned to be at least two-thirds of the length L1 of the handle 12 (see FIG. 17). Support groove 70 may also be substantially the same length as handle 12. While support groove 70 may be longer or shorter, generally, a length of at least two-thirds of the length of handle 12 or more will tend to provide more support for the razor handle. Also, in a preferred embodiment, handle support 96 may have the shape of a hollow tube, or cylinder, sliced lengthwise, with support groove 70 being defined by the inner surface of handle support 96, and having a semi-circular cross-section (not shown). Further, in a preferred embodiment, support groove 70 is substantially perpendicular to well cover 90 when well cover 90 is disposed on well opening 84. An oil 30, or some other liquid is disposed in well 8 as discussed with regard to the previously discussed embodiments. Well cover 90 is then placed over well opening 84, with handle 12 passing through handle slot 92 in well cover 90 and sealing blade 11 and well 8 therein, further protecting them from dirt and oxidation. When a user is ready to use the razor 13, the user may use the lift handle 2 to open well cover 90 in order to access the razor 13. In addition, internal well cover 98, being separate and distinct from well cover 90, may be disposed over well opening 84, and below well cover 90. In this embodiment, well cover 90 may have decorative features to enhance the esthetic appearance of storage device 100.

As can be seen by non-limiting examples shown in FIGS. 17 and 18, storage device 100 may include features such that storage device 100 has the appearance of a sailboat, or other whimsical item. The benefit of having a functional razor storage device 100 with a whimsical appearance is that the item may be more pleasing to the eye of some users when placed on, for example, a bathroom counter.

It will thus be seen that the objects set forth above, among those made apparent from the preceding description, are efficiently attained and, since certain changes may be made in the above construction without departing from the spirit and scope of the invention, it is intended that all mater contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall there between.

What is claimed is:

1. A storage device for storing a shaving razor having a handle and a blade so that the blade is disposed in a liquid, comprising:

a housing comprising a front wall defining in part a housing opening on the front side of said housing for receiving the handle and the blade;

said housing further comprising a handle receiving portion, disposed within said housing, that receives and aligns the handle;

a liquid storage well formed within said housing for storing the liquid and receiving the blade therein;

a front lip formed on said front wall for supporting the handle;

a handle slot disposed in said housing for receiving the handle so that the blade is positioned in said liquid storage well, and the handle can pivot in said housing opening between a first position in said slot to a second position in said housing opening;

a blade catch member disposed internally of said housing between said handle slot and liquid storage well to engage the blade and to position the blade above said liquid storage well when the handle is in said second position; and a lid positioned over said housing opening and said lid is pivotally attached to said housing.

2. The storage device of claim 1, said liquid storage well further comprising at least one rounded bottom corner.

3. A storage device for storing a shaving razor having a handle and a blade so that the blade is disposed in a liquid, comprising:

a housing having a liquid storage well formed therein for storing the liquid and receiving the blade therein, said liquid storage well defining a well opening;

a handle support groove defined in said housing for receiving the handle and for allowing the razor to be positioned in said liquid storage well; and a well cover removably positioned over said well opening, said well cover defining a handle slot for receiving the handle when said well cover is positioned over said well opening.

4. The storage device of claim 3 wherein the handle has a first length, said handle support groove has a second length, and said second length is at least two-thirds of the length of the first length.

5. A method of manufacturing a storage device for storing a shaving razor having a handle and a blade so that the blade is disposed in a liquid, comprising the steps of:

providing a housing having a front wall defining in part a housing opening on the front side of said housing; at least one recess in said housing, a liquid storage well within said housing, a front lip on said front wall, a handle slot in said housing, a blade catch member located internally of said housing, and having a lid; and placing said lid on said housing at a position over said housing opening.

6. A method of manufacturing a storage device for storing a shaving razor having a handle and a blade so that the blade is disposed in a liquid, comprising the steps of:

forming a housing having a front wall defining in part a housing opening on the front side of said housing; at least one recess in said housing, a liquid storage well within said housing, a front lip on said front wall, a handle slot in said housing, a blade catch member located internally of said housing;

forming a lid; and placing said lid on said housing at a position over said housing opening.

7. A method of storing and then using a shaving razor having a handle and a blade, comprising the steps of:

disposing the handle in a handle slot within a housing, in a first position, such that the blade is disposed in a liquid storage well containing a liquid;

disposing a lid over a housing opening in said housing;

removing said lid from said housing opening;

repositioning the handle and the blade into a second position such that the blade abuts a blade catch member, and the handle is supported by a lip, such that excess oil drains from the blade into a liquid storage well; and using said shaving razor to shave.

* * * * *